United States Patent [19]

Skretting

[11] 4,031,013

[45] June 21, 1977

[54] METHOD AND APPARATUS FOR FIBER SUSPENSION DEWATERING

[75] Inventor: Arne Skretting, Karlstad, Sweden

[73] Assignee: Kamyr Aktiebolag, Karlstad, Sweden

[22] Filed: Mar. 26, 1975

[21] Appl. No.: 562,185

[30] Foreign Application Priority Data

Apr. 2, 1974 Sweden ..... 7404409

[52] U.S. Cl. ..... 210/326; 210/330; 209/268; 209/306; 162/342

[51] Int. Cl.[2] ..... B01D 33/06; B01D 33/10

[58] Field of Search ..... 162/323, 356, 342; 209/301, 303, 304, 268, 273, 305, 306, 300; 210/77, 326, 329, 332, 333, 393, 396, 397, 330

[56] References Cited

UNITED STATES PATENTS

| | | | |
|---|---|---|---|
| 2,860,973 | 11/1958 | Wells | 210/396 |
| 3,019,903 | 2/1962 | Daane | 210/329 |
| 3,241,676 | 3/1966 | Neuville et al. | 210/77 |
| 3,263,598 | 8/1966 | Sylla | 210/326 |
| 3,845,863 | 11/1974 | Savia | 209/303 |

*Primary Examiner*—Frank A. Spear, Jr.
*Assistant Examiner*—Ernest G. Therkorn
*Attorney, Agent, or Firm*—Cushman, Darby & Cushman

[57] ABSTRACT

A method and apparatus for dewatering of cellulose pulp or other fiber suspensions. A suspension of relatively low solids concentration is passed into a sealed housing through an inlet, substantially filling the housing. The suspension is dewatered by bringing it into contact with perforated surfaces of a pair of drums or the like mounted for rotation about a vertical axis within the housing. Liquid from the suspension passes into an interior drum chamber, and at least a portion thereof is expelled from the housing through a liquid outlet. After passing a nip point between the two drums, the suspension has a higher solids concentration than the desired product suspension, and an amount of liquid is added thereto from the drum interior to dilute it to the final concentration.

2 Claims, 2 Drawing Figures

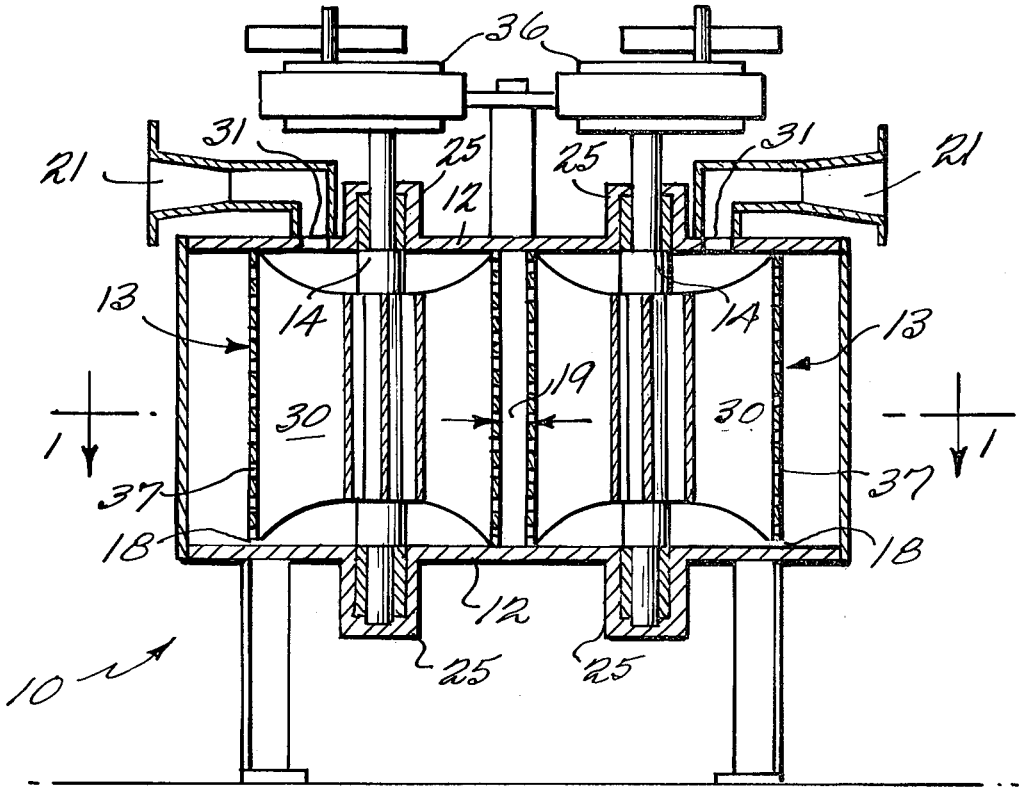
Fig. 2
Fig. 1
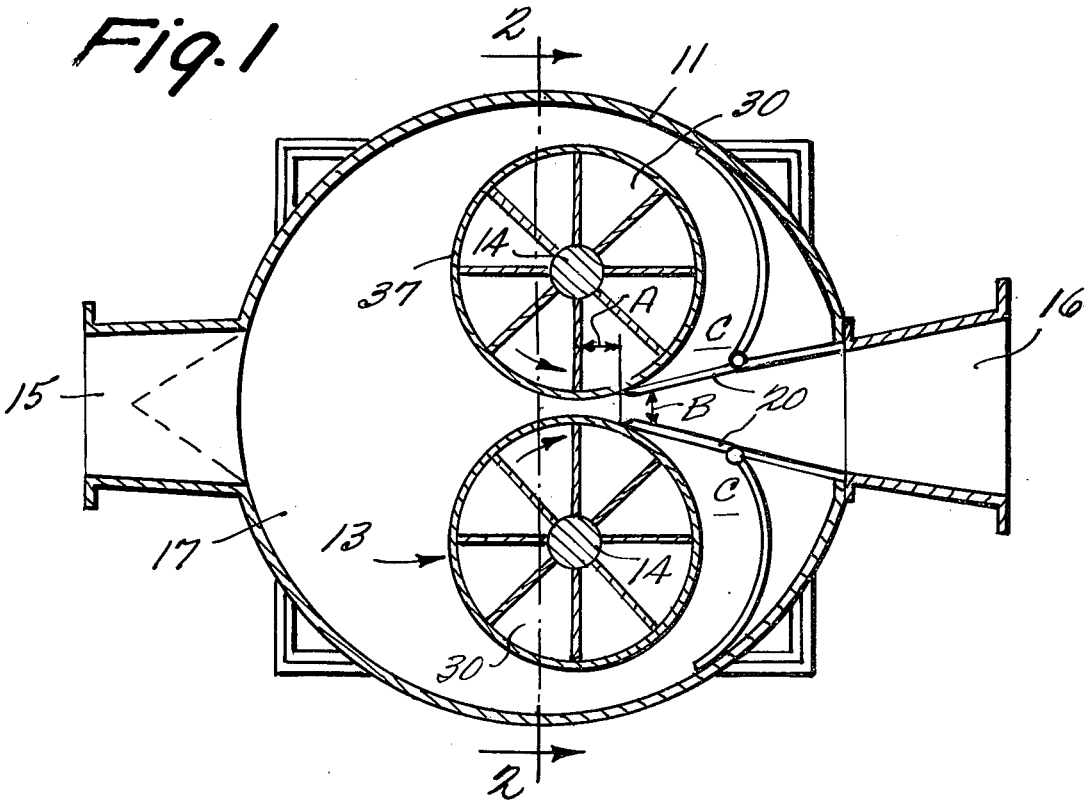

METHOD AND APPARATUS FOR FIBER SUSPENSION DEWATERING

BACKGROUND AND SUMMARY OF THE INVENTION

The present invention relates to the dewatering to a desired concentration of fiber-containing material in suspension, especially cellulose pulp, obtained through delignification of wood or other fiber containing material.

Prior art dewatering apparatus has usually fallen into one of the following classes: one or more perforated rotating drums in a trough; presses with two or more perforated or non-perforated rolls; screw presses; and centrifugal devices. The device according to the present invention combines the rotating drums in a trough and roll press concepts into an improved device. Prior art dewatering devices are usually of an open design, whereby air may contact the pulp suspension, while according to the apparatus of the present invention dewatering takes place in a closed space so that the chances of air contacting the suspension are greatly diminished.

According to the method of the present invention, a pulp suspension is dewatered to a solids concentration that is higher than the desired concentration, and thereafter a quantity of liquid is added thereto to obtain the desired solids concentration of the pulp. The added liquid passes through perforations in the drums according to the present invention, resulting in cleaning thereof.

It is the primary object of the present invention to provide improved pulp dewatering apparatus, and an improved method for pulp dewatering. This and other objects of the invention will become clear from an inspection of the detailed description of the invention, and from the appended claims.

BRIEF DESCRIPTION OF THE DRAWINGS

FIG. 1 is a top sectional view of exemplary apparatus according to the present invention, taken along lines 1—1 of FIG. 2, and FIG. 2 is a side cross sectional view of the apparatus shown in FIG. 1, taken along lines 2—2 of FIG. 1.

DETAILED DESCRIPTION OF THE INVENTION

Exemplary dewatering apparatus according to the present invention is shown generally at 10 in the drawings. The apparatus preferably comprises a cylindrical housing 11 having an interior space 17 thereof, and plane end walls 12 sealing the top and bottom surfaces thereof. An inlet (or inlets) 15 is provided for admitting relatively dilute pulp into the interior 17 of the housing 11, and an outlet 16 is provided for the removal of relatively concentrated pulp after dewatering thereof.

Mounted within the housing 11 adjacent the outlet 16 preferably are a pair of identical drums or rolls 13 mounted for rotation about vertical shafts 14. The drums are adapted to be driven in opposite directions, the top drum 13, as shown in FIG. 1, adapted to be rotated counterclockwise and the bottom drum 13, as shown in FIG. 1 adapted to be rotated clockwise. The exterior surface 37 of each of the drums 13 is perforated so as to allow the passage of liquids therethrough, but not the passage of solids. Each drum 13 is preferably spaced only a small distance 18 from the bottom wall 12 of the housing 11.

Each of the drums 13 may be powered for rotation by suitable variable drive means 36 or the like, and the shafts 14 about which the drums 13 are adapted to rotate are preferably mounted to the housing 11 by suitable adjustable bearings 25. With such an adjustable bearing mounting, the "press nip" 19 between the drums 13 may be adjusted. The interior chamber 30 of each of the drums preferably communicates through an opening 31 in upper end wall 12 with a liquid outlet 21, whereby liquid from the chamber 30 may flow away from the apparatus 10.

Located adjacent the pulp outlet 16 of the housing 11, there preferably are a pair of scraping and sealing blades 20, hereinafter called "doctor" blades. These blades extend the height of the housing 11, and prevent passage of pulp or liquid through the outlet 6 except through the opening B formed therebetween. The blades 20 are so mounted that the leading, scraping edges thereof are adapted to be adjacent or in contact with the peripheries of the drums 13, and spaced a distance A from the axis of rotation of the drums 13. It will thus be seen that with such a relative mounting of the drums 13 and the blades 20, there will be a portion of the periphery 37 of each drum 13 between the nip 19 and the doctor blades 20.

Operation of the apparatus shown in FIGS. 1 and 2 is as follows: Relatively low solids concentration pulp is introduced into inlet 15 to the interior 17 of housing 11, filling the entire interior 17 thereof. The relative pressures at the various inlets and outlets of the housing 11 are controlled so that the highest pressure is at inlet 15, and the lowest pressure at outlet 16, with the pressure at outlet 21 intermediate the pressures at the points 15 and 16, whereby a pressure differential is established. Any suitable pressure regulating means may be employed for maintaining such pressure differentials. As pulp passes through the housing 11 under the influence of the differential pressure, it contacts the exterior surfaces 37 of the drums 13, and liquid passes through the surfaces 37 and into the interior chambers 30 of the drums 13. A fiber layer is built up on the exterior surfaces 37 of the drums 13, extending from a minimum thickness in the areas C on the "backsides" of the drums 13, to a maximum thickness adjacent the nip 19. By adjustment of the nip 19, the concentration of the pulp at the nip 19 may also be adjusted. After passing through the nip 19, a "pulp plug" moves outwardly through the outlet 16 of the housing 11. It will be seen that since the pressure of liquid within the chambers 30 is greater than the pressure in the opening B between the doctor blades 20 adjacent the outlet 16, liquid will be forced outwardly through the surfaces 37 of the drums 13 from the chambers 30 along the distance of the surfaces 37 corresponding to the distance A, thereby diluting the pulp concentration and assisting the blades 20 in removing the collected fibers from the surfaces 37 of the drums 13.

According to the method of the present invention, one adjusts the nip 19 of the rollers 13 so that a higher concentration pulp is obtained at the nip 19 than is desired at the outlet 16, so that after dilution by water flowing into the pulp stream after passage through the nip 19 the desired concentration of pulp is obtained. An exemplary series of concentrations that might be utilized is as follows: If the concentration of pulp at inlet 15 is 3–6%, and a concentration of 8–12% at the outlet 16 is desired, the nip 19 is adjusted so that the concentration of the pulp at the nip 19 is about 15–20%, whereby after dilution thereof with water flowing through the drum surfaces 37 from the chambers 30, the desired 8–12% concentration will be obtained.

The apparatus and method according to the present invention has many advantages over prior art devices. For example, no press baffles or similar devices are needed, almost the whole 360° surfaces of the drums are active in dewatering, and a relatively large capacity is possible due to the large dewatering area and the high speed revolution of the drums. The manufacturing costs are relatively low, as are the energy requirements. Prevention of the pulp coming in contact with air is also achieved, which is desirable since air contact may result in subsequent foaming of the pulp, the evolution of noxious gases, and heat losses. Location of the outlets 21 above the housing 11 facilitates the elimination of air from the system.

The apparatus according to the present invention may be utilized at any point in a cellulose factory for thickening pulp where pulp thickening is desired. Since the assembly does not provide for air introduction, it can be utilized in and between stages where it is required that the pulp be at superatmospheric pressures.

While the apparatus and method according to the invention have been herein shown and described in what is presently conceived to be the most practical and preferred embodiment, it will be obvious to one of ordinary skill in the art that many modifications may be made thereof within the scope of the invention. For instance, only one drum 13 may be provided, cooperating with a flat surface adjacent the outlet 16, and a doctor blade 20 associated therewith. Also, more than two (i.e. four) drums may be provided. Also, liquid from another source besides the separated liquid may be introduced through chamber 30 to the portion A of the drums 13 by providing baffles within the drum chambers 30. Such liquid may be for washing, bleaching, or other purposes. Many other modifications are also possible, therefore it is intended that the invention be accorded the broadest scope of the appended claims so as to encompass all equivalent structures and methods.

What is claimed is:

1. Apparatus for dewatering a fiber suspension comprising a. a sealed housing having an inlet at a first pressure for introduction of a fiber suspension having a relatively low solids concentration, and a first outlet at a second pressure less than said first pressure for removal of a fiber suspension having a relatively high solids concentration, b. first and second drums mounted for rotation about vertical axes in the vicinity of said first outlet, each of said drums having a perforated exterior surface in substantial 360° engagement with suspension in said housing and an inner liquid chamber, and said exterior surfaces of said drums cooperating for pressing liquid from suspension passing therebetween into the interior chamber of the drums, said drums having a nip point therebetween, c. means for adjustably mounting shafts defining said drums' vertical axes so that the nip between the drums can be adjusted and thereby the concentration of suspension exiting said first outlet, d. a pair of second outlets from said housing at a third pressure intermediate said first and second pressures, a said second outlet being located above each of said drum chambers and spaced from the shaft mounting each drum for rotation about a vertical axis, e. means for rotating said drums about their vertical axes in a direction so that solids engaged thereby are adapted to flow toward said first outlet, and f. means for substantially preventing the passage of fiber suspension through said first outlet without passing through said nip point, said means including a first member having an extending edge thereof adjacent the periphery of said first drum at a point spaced toward said outlet from said nip point, and a second member having an extending edge thereof for cooperation with said second drum, whereby fiber suspension introduced into said inlet will pass through said nip, liquid being extracted therefrom, and will pass through said first outlet after addition thereto of an amount of liquid from the interior chambers of said drums.

2. Apparatus as recited in claim 12 wherein said pulp passage preventing members comprise a pair of blade members adapted to facilitate removal of built-up fibers on the exterior surfaces of the drums.

* * * * *